United States Patent [19]

Wilhere

[11] 4,151,867

[45] May 1, 1979

[54] BOTTLE FILLING VALVE

[75] Inventor: Charles V. Wilhere, Pittsburgh, Pa.

[73] Assignee: Horix Manufacturing Company, McKees Rocks, Pa.

[21] Appl. No.: 874,681

[22] Filed: Feb. 3, 1978

[51] Int. Cl.[2] ..... B65B 1/04

[52] U.S. Cl. ..... 141/291; 141/392

[58] Field of Search ..... 141/165, 172, 270, 275–278, 141/292–295, 301, 312, 372, 392

[56] References Cited

U.S. PATENT DOCUMENTS

| | | | |
|---|---|---|---|
| 1,793,684 | 2/1931 | Dunn | 141/293 |
| 2,112,199 | 3/1938 | Kantor et al. | 141/292 X |
| 2,461,326 | 2/1949 | Kantor et al. | 141/294 X |
| 2,591,071 | 4/1952 | Huggins et al. | 141/140 |
| 3,879,987 | 4/1975 | Yasuhiro et al. | 141/165 |

*Primary Examiner*—Charles E. Phillips

*Attorney, Agent, or Firm*—Brown, Flick & Peckham

[57] ABSTRACT

A vertical nozzle extending downwardly from the bottom of a tank supports below it a tubular member communicating with the inside of the nozzle and having an outlet in its side normally closed by a sleeve slidably mounted on the tubular member and in the nozzle and provided with a collar spaced below the nozzle and pressed downwardly by a coil spring to normally hold the sleeve in a lower position closing the valve outlet. A downwardly facing sealing washer encircles the sleeve below the collar, and a telescoping bottle guide encircles the nozzle and sleeve and has an opening in its lower end coaxial with the sleeve and small enough for the lower end of the guide around the opening to be engaged by the neck ring of an upwardly moving bottle, which will telescope the guide and move it upwardly while opening the valve.

2 Claims, 3 Drawing Figures

BOTTLE FILLING VALVE

Figure 1:
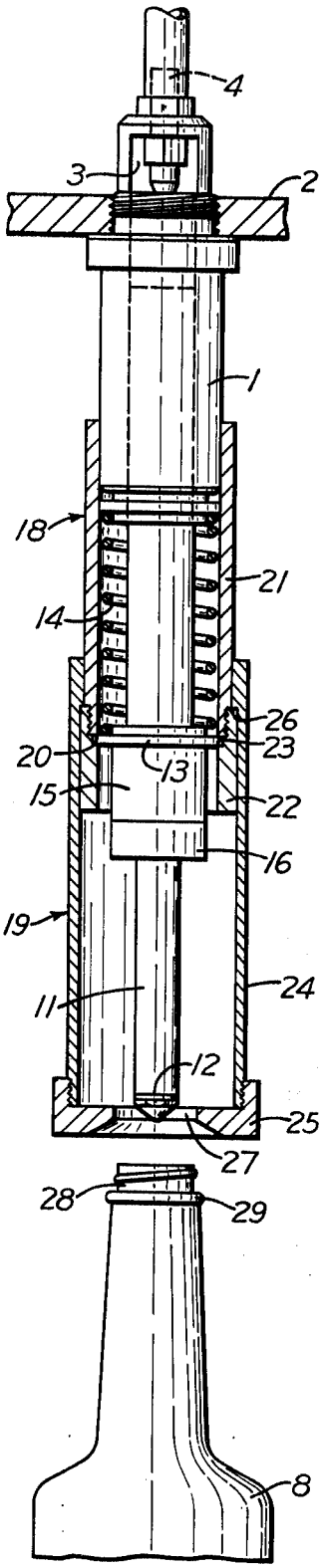

U.S. Pat. No. 2,591,071 shows a bottle filling machine provided with guides below the tank for centering the open upper ends of bottles relative to the filling valves as the bottles are elevated into filling position. The neck of each bottle enters one of the guides and engages a sealing washer before lifting the guide. It is only upon further elevation of the bottle that the guide is lifted and the valve is opened. With such an arrangement the guide has a vertical stroke equal to the opening stroke of the filling valve, and the entry opening into the lower end of the guide must be large enough to receive the neck of the bottle while it is being lifted into contact with the sealing washer. Generally, the bottle handling parts of the machine locate the bottles directly in line with the filling valves so that as a bottle is lifted its upper end does not comes in contact with the guide. Nevertheless, commercially produced bottles have tolerances of diameter, perpendicularity and ellipticity that can displace the top of the bottles as much as one-fourth inch to the side of the vertical axis of the filling valve. In such cases, the bottle must be moved laterally by the guide to permit the lower end of the filling valve to enter the bottle.

Glass bottles used by bottlers of distilled spirits and wines have long necks. Some of these bottles have an upper end or finish for receiving a cork. With a cork finish, the finish ring at the bottom of the finish may be as large in diameter as the bottle neck. In such cases the entry opening into the guide can be sized for operation as described in the above-mentioned patent and there is no problem. More often, however, the bottles have a threaded finish for receiving a screw cap with the bottle thread diameter and with a projecting ring at the bottom of the finish generally smaller than the neck diameter. This type of bottle requires the entry opening of the guide to be made large enough to admit the finish plus enough clearance so that the guide can be lifted by the bottle neck within the available stroke limit. The difficulty is that in such cases the guide will not always center the bottle for free entry of the filling valve into the bottle, which may result in the valve chipping the bottle. If the guide is made longer so that the ring below the bottle finish will be inside the guide opening before the filling valve starts to enter the bottle, a higher container lift will be required to obtain the needed filling height and valve opening. On the other hand, if the entry opening of the guide is made smaller so that the finish ring cannot enter the guide, the guide will need a longer stroke than is customary and that would require a longer nozzle and other filling valve parts of greater length.

It is among the objects of this invention to provide a bottle filling valve, in which the entry opening of the bottle guide can be sized to suit the bottle finish without changing the distance the bottle must be lifted or the length of any of the parts of the filling valve, and which permits this to be done while maintaining maximum filling heights and valve strokes.

Figure 2:
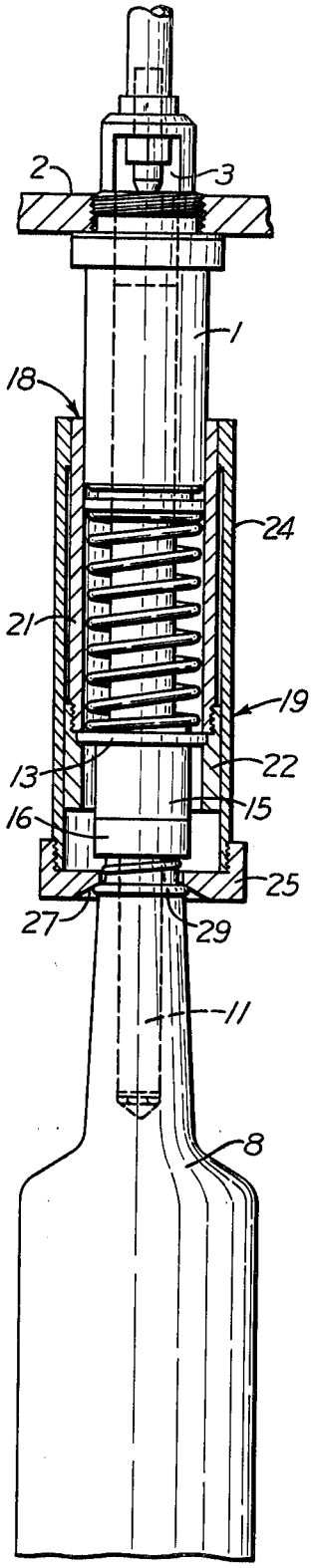
Figure 3:
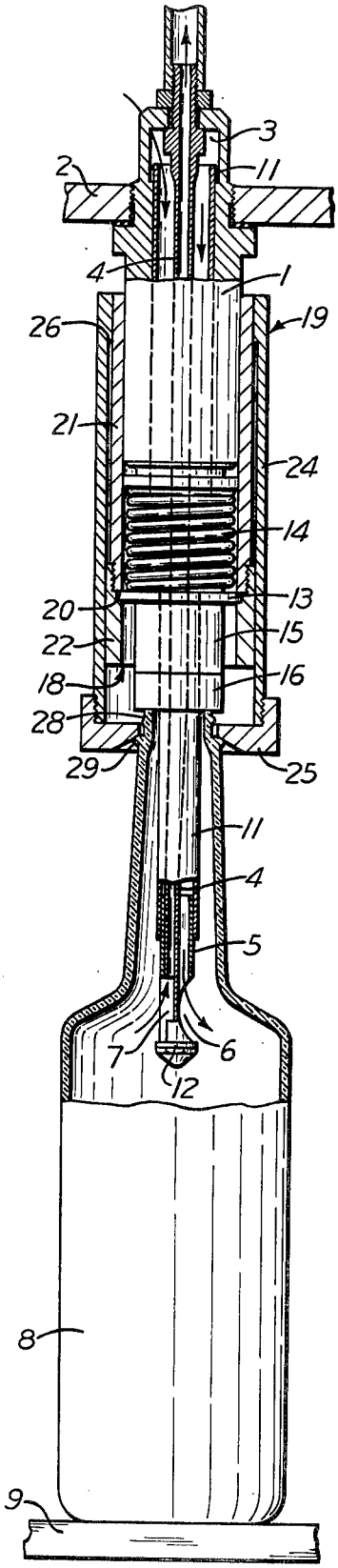

The preferred embodiment of the invention is illustrated in the accompanying drawings, in which FIG. 1 shows a filling valve supported by a tank, with the bottle guide shown in vertical section;

FIG. 2 is a similar view but with a bottle shown at the moment it engages the sealing washer of the valve; and FIG. 3 is also a similar view but with additional parts shown in section and with the valve open and the bottle guide in its upper position.

Referring to FIG. 3 of the drawings, a valve nozzle 1 is screwed up into an opening in the bottom of a tank 2 for holding a liquid or semi-liquid that is to be dispensed into bottles. The upper end portion of the nozzle projects a short distance up into the tank and has diametrically opposite openings 3 in its side to admit liquid to the nozzle. The upper end of the nozzle supports the upper end of a rigid air tube 4 that extends down through the nozzle and a considerable distance below it. The lower end of this tube supports a short rigid tubular member 5 that has an opening 6 in one side serving as a liquid outlet, and an opening 7 in its opposite side communicating with the lower end of the tube for escape of air from a bottle 8 resting on a vertically movable support 9 and being filled.

Slidably mounted on tubular member 5 there is a sleeve 11, the lower end of which is normally seated on a gasket 12 at the closed lower end of the tubular member, as shown in FIG. 1. Therefore, this sleeve normally closes the openings in the side of the tubular member. The sleeve extends up into the nozzle and is enlarged to slidably engage the inner wall of the nozzle. At a point some distance below the nozzle the sleeve is provided with a collar 13, between which and the lower end of the nozzle a coil spring 14 is compressed to normally press the sleeve downwardly into valve closing position. Directly below this collar there is a spacer 15, at the lower end of which a sealing washer 16 of rubber or the like encircles the sleeve.

It is a feature of this invention that a guide is provided for guiding the open upper end of the bottle up around the lower end of the valve sleeve 11. Accordingly, as will be seen in FIG. 1, a guide is provided that can be telescoped. The guide is formed from two main parts; an upper cylinder 18 and a lower cylinder 19. The upper end portion of the upper cylinder is slidably mounted on nozzle 1, while the upper end portion of the lower cylinder is slidably mounted on the upper cylinder. The upper cylinder is provided with a radial shoulder 20 that rests on collar 13. Preferably the upper cylinder is formed from an upper cylindrical member 21 and a lower ring 22 that are screwed together, with the lower end of the upper member forming shoulder 20. The ring also may be provided with a radial shoulder 23 for engaging the bottom of the collar so that the collar is clamped between the two shoulders. Likewise, it is preferred to make the lower cylinder 19 from a cylindrical member 24, onto the lower end of which a removable cap 25 is screwed. The upper end portion of the lower cylinder is provided with an internal shoulder 26 that normally rests on the laterally projecting upper end of ring 22, which has a slightly larger diameter than upper member 21, whereby to support the lower cylinder from the upper cylinder, lower cylinder 19 slidably engages both member 21 and ring 22.

The cap at the lower end of the guide is provided with an entry opening 27 that is coaxial with the sleeve and just large enough to receive the threaded finish 28 of the bottle. The opening is too small to permit the neck ring 29 to pass through it, so the lower end of the guide around the opening is engaged by the ring when a bottle is elevated. The lower part of the entry opening flares downwardly to guide the upper end of an off center bottle into the opening.

OPERATION

The positions of the different elements when the valve is closed and there is no bottle engaging the guide is shown in FIG. 1. When a bottle is raised by its support 9, the bottle finish will enter opening 27 in the bottom of the guide and extend a very short distance up around the lower end of the closed valve. Further movement of the finish into the guide is prevented by the engagement of neck ring 29 with the lower end of the guide around the entry opening. Consequently, continuing upward movement of the bottle slides the lower cylinder 19 of the guide upwardly on the upper cylinder until the upper end of the bottle engages sealing washer 16 as shown in FIG. 2. Still further upward movement of the bottle will not only raise the lower cylinder still further, but it will also raise the sealing washer, which slides sleeve 11 upwardly to open the valve and to slide the upper cylinder 21 of the guide up around the nozzle as the coil spring is compressed. This is shown in FIG. 3.

By using a telescoping guide instead of a unitary guide as heretofore, the upper end of the guide is raised around the nozzle no higher than a unitary guide. Yet, the lower end of the guide is moved a much greater distance than before, due to the fact that the bottle neck does not enter the guide. The upward travel of the bottle does not have to be increased and no change is necessary for the valve stroke nor in the valve parts with which the guide is associated. Only the construction of the guide is changed. A further important advantage is that the upper end of the bottle is correctly positioned by the guide for entry of the valve tip into the bottle, so there is no danger of the valve chipping the upper end of the bottle.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A filling valve for delivering fluid from a tank to a bottle having an integral ring encircling its neck at the bottom of its finish, the valve comprising a vertical nozzle adapted to extend downwardly from the bottom of a tank, a tubular member extending through and below the nozzle and having an upper end communicating with the inside of the nozzle and having a fluid outlet in its side, a sleeve slidably mounted in the nozzle and on said tubular member and provided with a collar spaced below the nozzle, a coil spring encircling the sleeve between the nozzle and said collar and urging the collar downwardly to normally hold the sleeve in a lower position closing said outlet, a downwardly facing sealing washer encircling the sleeve in fixed position thereon below said collar, and a telescoping bottle guide encircling said nozzle and sleeve and normally extending below the sleeve, said guide having an opening in its lower end coaxial with the sleeve and small enough for the lower end of the guide around the opening to be engaged by the neck ring of an upwardly moving bottle, said guide including upper and lower cylinders, the upper cylinder encircling said spring and being slidably mounted on the nozzle and having a shoulder resting on said collar, and the lower cylinder being slidably mounted on the upper cylinder and movable upwardly thereon by the bottle far enough for the bottle to engage said sealing washer, whereby continuing upwardly movement of the bottle will cause said collar to move the upper cylinder upward on said nozzle as said sleeve uncovers said fluid outlet.

2. A filling valve according to claim 1, in which said upper guide cylinder is formed from upper and lower members detachably connected together adjacent said collar, said upper cylinder shoulder is formed by the lower end of said upper member, and said lower member is provided with a shoulder engaging the bottom of the collar, whereby the collar is clamped between said shoulders.

* * * * *